US005482191A

United States Patent [19]

Kaufmann

[11] Patent Number: 5,482,191

[45] Date of Patent: Jan. 9, 1996

[54] DEVICE FOR FILLING WRITING, DRAWING, PRINTING OR PAINTING UTENSILS

[75] Inventor: Rainer Kaufmann, Delmenhorst, Germany

[73] Assignee: Dataprint Datendrucksysteme R. Kaufmann KG, Delmenhorst, Germany

[21] Appl. No.: 469,087

[22] Filed: Jun. 5, 1995

Related U.S. Application Data

[63] Continuation of Ser. No. 150,028, filed as PCT/DE92/00348, Apr. 29, 1992, abandoned.

[30] Foreign Application Priority Data

May 10, 1991 [DE] Germany ..... 41 15 275.1

[51] Int. Cl.[6] ..... B43L 27/00

[52] U.S. Cl. ..... 222/577; 118/268

[58] Field of Search ..... 222/576–585, 222/205; 401/119, 131, 222; 118/268

[56] References Cited

U.S. PATENT DOCUMENTS

| | | | |
|---|---|---|---|
| 1,957 | 1/1841 | Farley | 22/578 |
| 742,929 | 11/1903 | Taber | 222/578 |
| 1,936,394 | 11/1933 | Hoffman | 222/577 |
| 1,939,707 | 12/1933 | Kerber | 222/578 X |
| 2,249,616 | 7/1941 | Martin | 222/585 |
| 2,629,359 | 2/1953 | Rosenthal | 222/578 X |
| 2,708,904 | 5/1955 | Rhoades . | |
| 2,889,810 | 6/1959 | Randolph | 222/577 |
| 3,035,542 | 5/1962 | Rosenthal . | |

FOREIGN PATENT DOCUMENTS

| | | |
|---|---|---|
| 0166552 | 1/1986 | European Pat. Off. . |
| 325195 | 4/1903 | France . |
| 455964 | 8/1913 | France . |
| 1330188 | 5/1963 | France . |

*Primary Examiner*—Kevin P. Shaver
*Attorney, Agent, or Firm*—Robert W. Becker & Associates

[57] ABSTRACT

A device for filling a writing utensil having an applicator tip for applying a liquid has a container for receiving a liquid. The container has an air inlet connection to connect the interior of the container to a surrounding atmosphere and further has an opening. A receiving member for receiving the writing utensil or a liquid reservoir of the writing utensil is provided, wherein the receiving member is sealingly connected within the opening. A capillary liquid conveying connection, having a first and a second end, for conveying the liquid from the container into a writing utensil or a liquid reservoir of a writing utensil is provided. The first end opens into the receiving member and contacts the writing tip of the writing utensil or the inlet of the liquid reservoir of the writing utensil. The air inlet connection has at least one chamber.

19 Claims, 3 Drawing Sheets

DEVICE FOR FILLING WRITING, DRAWING, PRINTING OR PAINTING UTENSILS

This application is a continuation, of application Ser. No. 08/150,028 filed as PCT/DE92/00348, Apr. 29, 1992, now abandoned.

BACKGROUND OF THE INVENTION

The invention relates to a device for filling writing, drawing, printing and painting utensils or reservoirs for writing liquids (writing utensils) with writing, drawing, printing, or painting liquid (writing liquid), comprising a container for receiving the writing liquid, the interior of which is connected to the atmosphere, having a capillary liquid conveying connection through which the transport of the writing liquid to the writing utensil is carried out.

Writing, drawing, printing, and painting utensils and/or reservoirs for writing liquids of such utensils, in the following referred to as writing utensils, are known and used in a plurality of embodiments. With writing utensils of this kind the writing liquid in most cases is stored in a capillary reservoir belonging to the writing utensil that for a so-called disposable writing utensils is not designed to be refilled with writing liquid, even though this refilling is in principle possible for most of such disposable writing utensils. Other writing utensils, in which the writing liquid is received in a capillary reservoir of the utensil and which are basically designed and suitable for refilling with writing liquid, exhibit problems of the kind that in general the degree of filling of the capillary reservoir cannot be detected from the exterior of the writing utensil and during the refilling process sometimes too much writing liquid is filled in, resulting in the disadvantage that the writing utensil will drip during use.

There are also writing utensils known in which the writing liquid is received in a cartridge that is refillable with a displacable piston (piston cartridge). The following problem occurs: By immersing the writing utensil into a conventional ink container, areas of the cartridge are wetted with the writing liquid which later will come into contact with the fingers of the user and soil them.

A further disadvantage during refilling of writing utensils with liquid reservoirs is that the container containing the refill writing liquid may be tipped over during the refilling process so that irrepreable damage can be caused on clothing, carpets, furniture etc. Furthermore it is disadvantageous that the user during the refilling process often is soiled with the writing liquid.

It is an object of the present invention to provide a device for filling writing utensils of the aforementioned kind with which an overfilling of the reservoir is impossible and with which the refilling process for certain writing utensils is possible in a fully automated manner, which is simple and inexpensive to manufacture and which is also able to refill disposable writing utensils with writing liquid which utensils are, in general, not designed suitable for refilling, with which the writing utensil, or areas thereof, are not soiled during refilling with the writing liquid, and which is leakproof even when the device is positioned with its opening pointing downward.

SUMMARY OF THE INVENTION

This object is solved by the present invention by providing a device for receiving the writing utensil in a sealing manner in the opening of the container, whereby one side of the capillary liquid conveying connection opens into this device and contacts a writing tip or opening of the writing utensil and that the connection to the atmosphere is achieved via a line that extends through at least one chamber.

The inventive device for filling a writing utensil having an applicator tip for applying a liquid is primarily characterized by:

a container for receiving a liquid, the container having an air inlet connection to connect an interior of the container to a surrounding atmosphere and further having an opening;

a receiving member for receiving the writing utensil or a liquid reservoir of the writing utensil, the receiving member sealingly connected within the opening;

a capillary liquid conveying connection, having a first and a second end, for conveying the liquid from the container into a writing utensil or a liquid reservoir of a writing utensil, the first end opening into the receiving member and contacting a writing tip of the writing utensil or an inlet of the liquid reservoir of the writing utensil; and the air inlet connection comprising at least one chamber.

Preferably, the at least one chamber contains a capillary medium.

The inventive device preferably further comprises a closure element for closing off at least the first end of the capillary liquid conveying connection to the atmosphere.

Advantageously, the location of contact between the first end of the capillary device and the writing tip of the writing utensil or the inlet of the liquid reservoir of the writing utensil is above a level of liquid in the container in a rest position (normal position) of the container.

Expediently, the flow of liquid through the capillary liquid conveying connection is interrupted when the container is positioned substantially upside down.

The air inlet connection has preferably an inlet opening in the interior of the container positioned in the area of an axis of the container.

In the rest position of the container the inlet opening is positioned above a level of liquid in the container.

The capillary liquid conveying connection advantageously comprises a mantle.

In a preferred embodiment of the present invention, the capillary liquid conveying connection extends into the vicinity of a bottom of the container.

Preferably, the capillary liquid conveying connection has a circular cross-section and a tubular wall for providing a capillary action.

The receiving member is preferably one-part shaped member of a substantially cylindrical cross-section.

In a preferred embodiment of the present invention, the inner wall of the receiving member has a plurality of projections extending substantially toward an axis of the receiving member.

The air inlet connection is expediently comprised of an inlet opening in the interior of the container, a mouth open to the atmosphere, and a plurality of the chambers connected between the inlet opening and the mouth. Preferably, the chambers have separating walls separating the chambers from one another and wherein between the chambers connecting elements are positioned, the connecting elements being in the form of through-openings in the separating walls of the chambers.

Expediently, the chambers have capillary grooves extending from a bottom of the chambers to the through-openings.

In a preferred embodiment of the invention, the chambers are arranged sequentially.

The receiving member has a receiving opening for the writing utensil or the liquid reservoir of the writing utensil.

Preferably, a closure element for closing the receiving opening is provided. The closure element has a projection that is insertable into the receiving opening. The projection, in a closing position of the closure element, closes off the mouth of the air inlet connection and the first end of the capillary liquid conveying connection.

The advantage of the inventive device lies essentially in the fact that the writing utensil or the reservoir for the writing liquid to be refilled is simply inserted into the device, respectively, positioned therein and that subsequently the refilling process for writing utensils with a capillary reservoir takes place completely automatically without the user of the device having to carry out any particular measures.

It is furthermore advantageous that disposable writing utensils, which are in general not designed to be refilled with writing liquid, as well as writing utensils designed for refilling can be refilled so that with the inventive device environmental protection concerns are advantageously taken into consideration since also so-called disposable writing utensils, which in the past have been disposed of after use, can be refilled as often as desired.

It is also advantageous that the flow of writing liquid through the capillary conveying connection is interrupted when the location of contact is facing downwardly so that improper handling of the device which may result, for example, in tipping over, does not result in disastrous consequences of irrepreable soiling of clothing, carpets, etc. Upon tipping over or shaking of the device no writing liquid can leak, i.e., the device is leak-proof.

It is furthermore advantageous that during filling a reservoir for writing liquid the inlet opening for the writing liquid may cover the opening of the capillary liquid conveying connection so as to exclude auxiliary air; accordingly, by displacing the piston of a cartridge of a accordingly designed reservoir for writing liquid, the writing liquid can be sucked from the container without auxiliary air.

It is also advantageous to provide a capillary medium within the chamber in which medium writing liquid, introduced through the air inlet connection from the interior of the container due to expansion of the air volume within the container caused by heating etc. or by shaking, dropping etc., may be received without a droplet exiting from the receiving member and thus from the device.

For the transport and the storage of the device it is advantageous that at least one end of the capillary liquid conveying connection is designed to be sealable to the atmosphere by a closure element.

Preferably, the location of contact of the writing tip or inlet opening of the reservoir for the writing liquid is connected with the capillary liquid conveying connection above the level of liquid in the container.

Advantageously, a writing liquid flow through the capillary liquid conveying connection is interrupted when the container is in a substantially downwardly oriented position.

In order to ensure that for any desired embodiment of the container for receiving the writing liquid a safeguard against leakage is provided, the inlet opening of the air inlet connection in the container interior is arranged in the area of the container axis.

For this purpose it is also advantageous that the air inlet opening relative to the maximally possible level of writing liquid within the container is arranged above the level of the writing liquid when the location of contact is in its upwardly oriented position (normal position).

According to a further advantageous embodiment, the capillary liquid conveying connection is provided with a mantle which serves as a mechanical stabilization of the liquid conveying connection and, on the other hand, prevents interaction of the writing liquid absorbed in the capillary liquid conveying connection with the interior of the container.

In order to ensure that actually substantially the entire volume of liquid in the container can be introduced into the capillary liquid conveying connection, the capillary liquid conveying connection extends advantageously into the vicinity of the bottom of the container, optionally with a capillary connection to the outer wall of the container.

As mentioned before, the device, especially the container, is not limited to a certain fixed outer or inner geometry, i.e., in principle, it can be designed to conform to any desired suitable shape, for example, in form of a bottle, whereby even the cross-sectional shape of the container may be selected as desired. Advantageously, the capillary liquid conveying connection has a tubular crosssection because such a cross-section is simple to manufacture and can be accommodated within a relatively little available space, whereby the tubular wall may constitute the capillary liquid conveying connection. The aforementioned mantle may surround the capillary liquid conveying connection inwardly and/or outwardly.

The receiving member itself is advantageously, as mentioned, sealingly received in the opening of the container, whereby for filling the container the receiving member is removed from the opening of the container and after completion of refilling is reinserted. The receiving member is preferably a substantially one-part cylindrically shaped element with substantially circular cross-section and forms substantially with its axis a common axis with the container. This receiving member stabilizes and automatically holds a writing utensil inserted into the receiving member for performing the refilling process.

In order to ensure that the writing utensil during the refilling step, i.e., when inserted into the receiving member, actually contacts with its writing tip substantially in a planar manner the end of the capillary liquid conveying connection ending in the receiving member, the interior surface of the receiving member is advantageously provided with a plurality of projections that are substantially oriented toward the axis of the receiving member which projection stabilize the writing utensil in its position. The projections have the advantage that different writing utensils of varying housing dimensions can be, when accordingly axially adjusted, inserted so that it is possible to securely hold different writing utensils during the refilling process.

In another advantageous embodiment of the invention the line between the inlet opening in the container and the mouth opening to the atmosphere is formed by a plurality of interconnected chambers. In this embodiment of the device leakage of writing liquid through the line open to the atmosphere is made more difficult, i.e., the container may be shaken extremely without the danger of having writing liquid leaking. The multi-chamber design is in the form of a labyrinth whereby this labyrinth will automatically drain when the interior of the container has a vacuum.

Even though it is in principle possible to connect the individual chambers with one another in any suitable manner, it has been shown to be advantageous when the connection between the chambers is in the form of openings in the separating walls of the chambers.

In principle, for the aforementioned embodiments of the device, the compensation of the vacuum within the container takes place as long as writing liquid from the sequentially arranged chambers can flow until they are completely empty. In one embodiment of the invention, in which the chambers are arranged adjacent to one another, capillary grooves extending from the bottom of the chambers advantageously open into the connections. In these capillary grooves the writing liquid rises and closes the connection openings between the chambers as long as writing liquid is present in the chambers. Subsequently, the air can pass through the labyrinth without obstruction.

It is in principle possible that the chambers can be connected to one another in any suitable manner. In addition to the arrangement of the chambers adjacent to one another it is also advantageous that the chambers are substantially arranged atop one another, whereby in this embodiment the writing liquid closes the openings due to gravity.

In order to ensure that the interior of the receiving member, which usually receives a part of the writing utensil to be refilled, is protected during transport and during storage against leakage of writing liquid, the closure element in another advantageous embodiment of the invention is provided with a projection to be inserted into the receiving opening such that in the closed position the mouth of the air inlet connection and/or the end of the capillary liquid conveying connection designed to contact the writing tip are closed off.

BRIEF DESCRIPTION OF THE DRAWINGS

The invention will now be described with the aid of the following schematic drawings with one exemplary embodiment. It is shown in.

DESCRIPTION OF PREFERRED EMBODIMENTS

Figure 2:
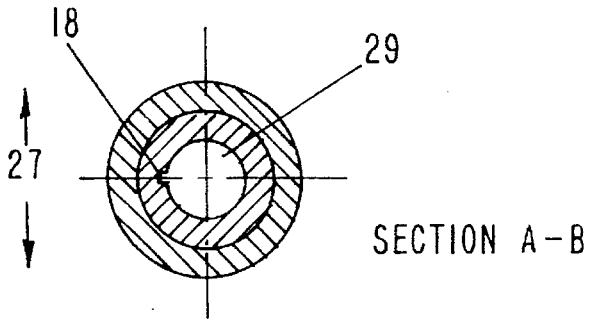
FIG. 2 a section along the line A–B of FIG. 1.

The device 10 is comprised substantially of a container 14 which in the embodiments represented in the drawings is essentially bottle-shaped. It should be noted however that the container 14 in principle may have any desired suitable form with any desired suitable cross-section. The device 10 further comprises a receiving member 17 which, in the embodiment shown in the drawings, has a substantially cylindrical construction with a substantially circular cross-section and is inserted air- and liquid-tightly in a detachable manner into the container refill opening 27 provided at the upper end of the container 14, compare especially FIG. 2. The axis 21 of the container and the axis 28 of the receiving member, in the shown embodiment of the device 10 are axially aligned with one another which, however, is not required in all cases. A capillary liquid conveying connection 16 is arranged axially relative to the receiving member 17 and extends from there into the interior of the container 15 and is also substantially cylindrically shaped. The capillary liquid conveying connection may be comprised of a tubular capillary or any suitable porous material, for example, of materials that are used conventionally for tips and reservoirs of conventional writing utensils 11. The upper end 160 of the capillary liquid conveying connection 16 projects into the area of the mouth 20 of the air inlet connection 18 into the interior 15 of the container, while the other end 161 extends into the interior 15 to the area of the bottom 25 of the container into the interior 15. The air inlet connection 18 between mouth 20 and the direct opening of the air inlet connection 18 into the interior 15 of the container is provided with a chamber 23 that is filled with a capillary medium 22.

Figure 1:
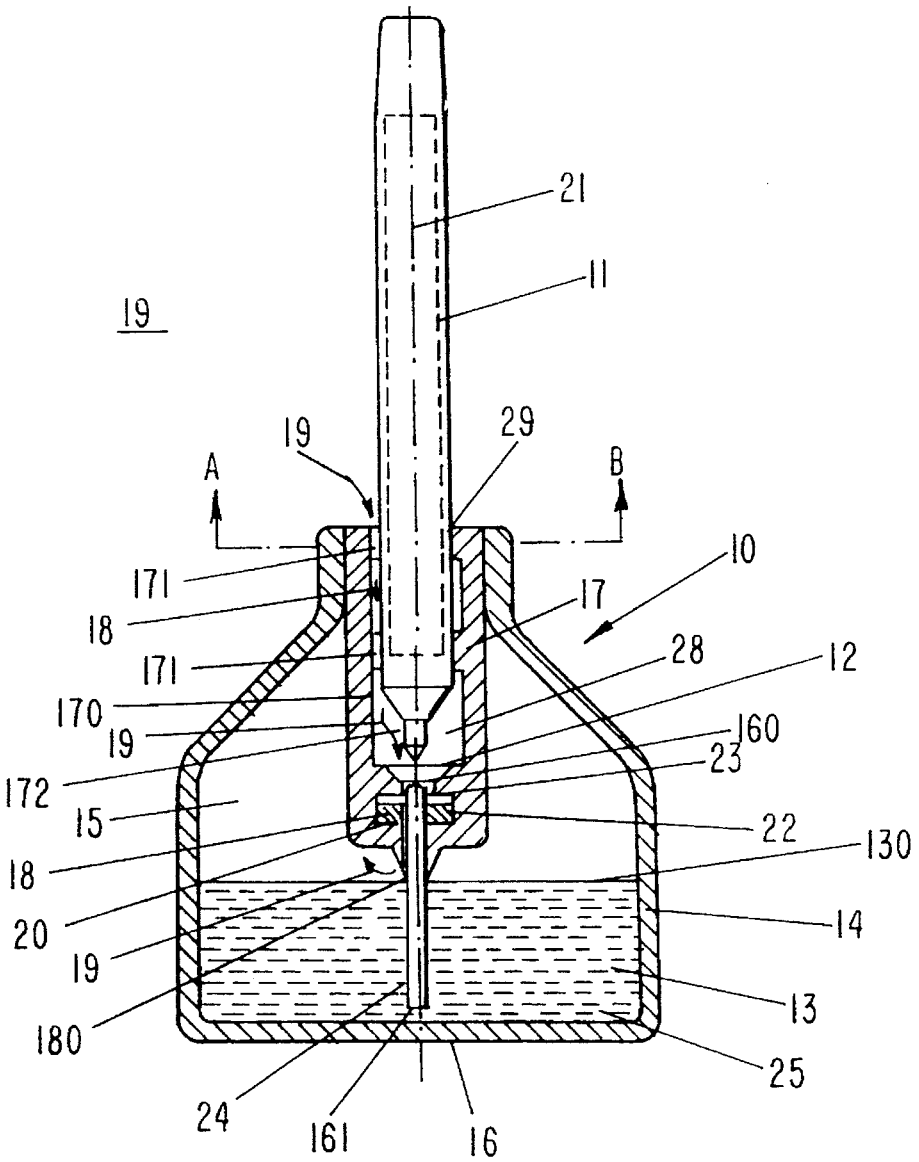
FIG. 1 a side view in section of a device with a writing utensil inserted into the receiving member of the device.
Figure 3:
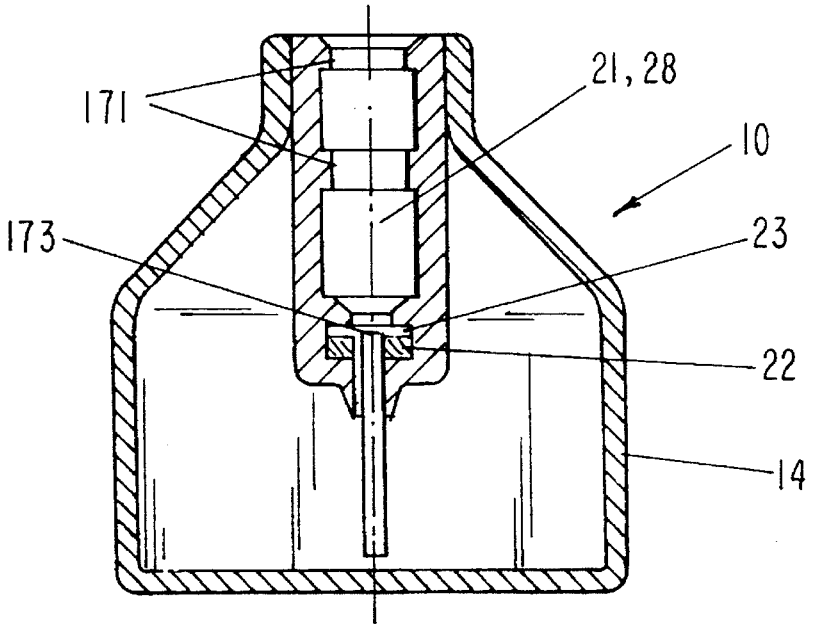
FIG. 3 a device according to FIG. 1, without the writing utensil inserted into the receiving member.

The receiving member 17 is provided at its inner surface 170 with a plurality of projections 171 extending substantial 1y toward the axis 28 which projections are either in the form of circumferential projections, compare FIG. 3, or burly individual projections, compare FIG. 1.

When filling the device 10, the receiving member 17 is first removed from the opening 27 of the container, which opening 27 is hermetically closed by the receiving member 17, and the container 14 is filled with writing liquid 13 up to a maximum filling level of half of its volume. Subsequently, the receiving member 17 is reinserted into the opening 27 of the container so that the container is again hermetically closed. The capillary liquid conveying connection 16 immersed in the interior 15 of the container, respectively, into the writing liquid 13 almost touches with its lower end 161 the bottom 25 of the container. Due to the capillary effect of the capillary liquid conveying connection 16 the writing liquid 13 is transported to the upper end 160 of the capillary liquid conveying connection 16 which in the area of the mouth 20 of the air inlet connection 18 projects into the receiving member 17.

For filling a writing utensil 11, the writing utensil 11 is inserted into the receiving opening 29 of the receiving member 17 until the writing utensil 11 with its writing tip 12 contacts the upper end 160 of the capillary liquid conveying connection. The writing liquid 13 thus flows, conveyed via the capillary liquid conveying connection 16, via the writing tip 12 into the capillary reservoir contained in the writing utensil. The writing liquid 13 overcomes without problems the transition of the high capillarity of the writing tip 12 of the writing utensil 11 to be filled into the low capillarity of the capillary reservoir of the writing utensil because independent of capillary discontinuities the writing liquid 13 rises as high as the capillary rise allows.

The capillary rise is determined by the length of the capillary liquid conveying connection 16 of the device 10 plus the length of the writing tip 12 and the length of the capillary reservoir within the writing utensil. Since the writing utensil to be refilled is dimensioned such that the writing liquid 13 received therein cannot drain, the only other factor determining the capillary rise is the length of the capillary liquid conveying connection 16. For this reason, the capillary liquid conveying connection 16 is dimensioned such that the writing utensil 12 to be refilled can be filled at least to about half with writing liquid 13. The capillary liquid conveying connection 16 therefore may be up to 50 mm long for al 1 conventional writing utensils 11.

When the writing utensil 11 after a certain time has been filled automatically with writing liquid 13, it may be removed from the receiving member 17; however, it may also always remain there, for example, with the device acting as a suitable stand. An overfilling is impossible due to the aforementioned relation with respect to the capillary rise.

Instead of filling a writing utensil 11 via the writing tip 12, it is also possible to directly fill a reservoir 21 for a writing liquid when such a reservoir is a detachable cartridge etc. or when, for example, on the backside of the writing utensil 11 a connector for refilling the reservoir is provided. The reservoir 21 for the writing liquid may also be a container for a writing liquid, in which the writing liquid can be sucked from the device 10 via the liquid conveying connection 16 by suction generated by a piston.

The position represented in FIG. 1 shows the container 14 in a vertical position as placed on a non-represented surface. The liquid conveying connection 16 is interrupted in a substantially horizontal position of the container 14 when the container 14 has been filled originally to only half its volume with liquid 13 because no writing liquid can enter into the liquid conveying connection 16. When the liquid conveying connection 16 is provided with a mantle 24, writing liquid 13 adhering to the mantle 24, even when the container is tilted about 180° from the position represented in FIG. 1, cannot leak via the end 160 of the liquid conveying connection. The capillary medium 22 arranged within the chamber 23 is furthermore able to receive writing liquid 13 which enters through the inlet opening 180 in the interior 15 of the container into the air inlet connection 18. It is therefore also possible to shake the device 10 for a limited time without writing liquid 13 leaking from the device.

Figure 4:
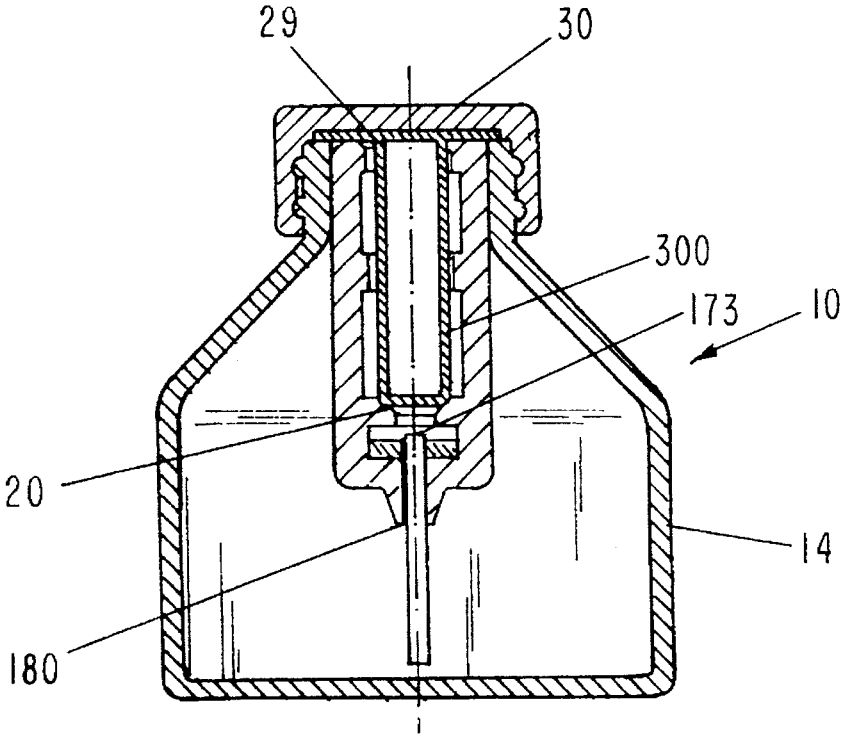
FIG. 4 a device provided with a closure element.

As represented in FIG. 4, the device 10 may be closed off by a closure element 30. The closure element 30 is provided with a projection 300 that projects into the interior 172 of the receiving member 17 which projection 300 closes off the mouth 20 of the air inlet connection 18 as well as the end 160 of the capillary fluid connection 16 extending into the interior 172.

However, any other suitable closure element is conceivable which protects the interior 172 against wetting with the writing liquid 13. It is also possible that the air inlet connection 18 opens at any other location of the device 10, respectively, the receiving member 17.

The closure element 30 with its projection 300, which is removable from the device 10, for transporting and storage purposes is placed over the opening 27 of the container, in a manner so as to close off the container 15 and the receiving member 17.

Figure 5:
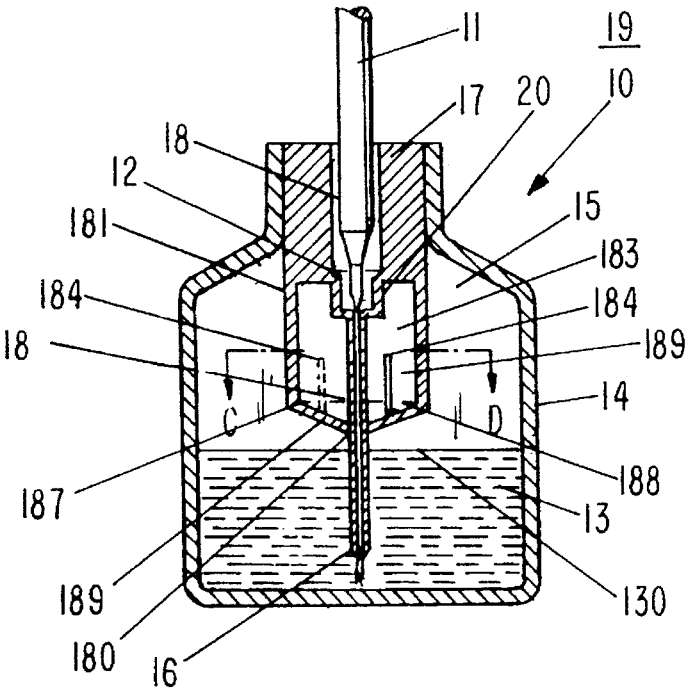
FIG. 5 a side view in section of a device with a writing utensil inserted into the receiving member of the device, whereby the receiving member is provided with a plurality of adjacently arranged chambers that form a portion of the air inlet connection.
Figure 5A:
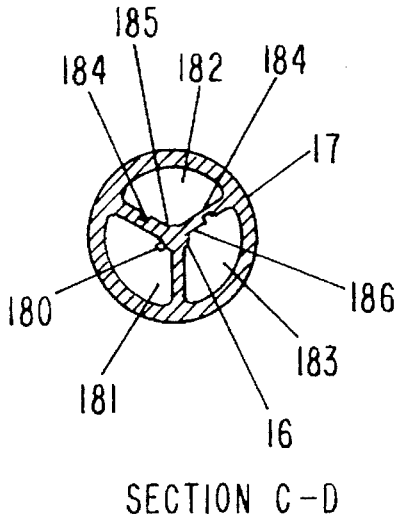
FIG. 5*a* a section along the line C–D of FIG. 5.
Figure 6:
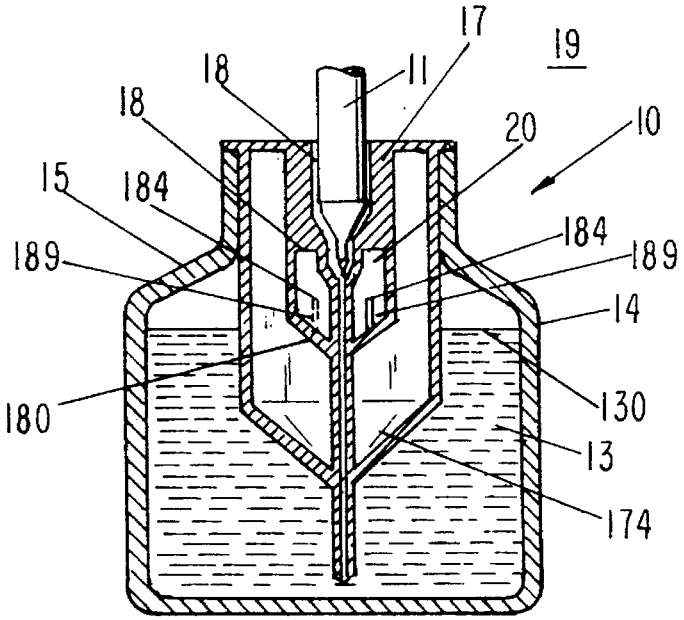
FIG. 6 a representation corresponding to FIG. 5, however with a further compensation chamber in front of the mouth of the air inlet connection.

In FIGS. 5 and 6 modifications of the device 10 are represented. In the embodiment shown in FIG. 5, the line 18, extending between the inlet opening 180 in the interior of the container and the mouth 20 open to the atmosphere 19, is provided with a plurality, in the present case three, interconnected chambers 181, 182, 183 having a connection 184 therebetween. The connection 184 itself, see also FIG. 5*a*, is embodied in the form of openings in the separating walls 185, 186 of the chambers. Capillary grooves 189, extending from the bottoms 187, 188 of the chambers, open into the connections 184. The sequentially connected chambers 181, 182, 183 form a labyrinth that the writing liquid 13, even after extreme shaking of the container 14, cannot penetrate so that the liquid cannot leak into the surrounding atmosphere 19. In principle, it is true for both embodiments of the device 10 according to FIG. 5 and according to FIG. 7, in which for reasons of simplification only the sequentially arranged chambers 181, 182, 183 are represented as a part of the air inlet connection 18, that writing liquid 13 in the chambers 181, 182, 183 that has been introduced by shaking of the container 14, can be automatically emptied when the interior 15 of the container 14 is under vacuum. The compensation of the vacuum is achieved with the writing liquid 13 from the chambers 181, 182, 183 until the chambers are completely empty.

In the embodiment of the device according to FIGS. 5, 5*a* the emptying takes place such that the writing liquid 13 in the capillary groove 189 rises and closes off the connection 184 (opening) between the chambers 181, 182, 183 as long as writing liquid 13 is present in the chambers 181, 182, 183. Subsequently, air can pass through the chambers 181, 182, 183. In the embodiment of the device according to FIG. 7, the writing liquid 13 closes the respective connections 184 (openings) due to the force of gravity.

For all embodiments of the device 10 according to FIGS. 1 through 7 it is true that the device is especially protected against leakage of writing liquid 13 when the container 14 is filled only to a maximum of half of its volume with writing liquid 13 since then the maximum writing liquid level 139 cannot reach the inlet opening 180.

Figure 7:
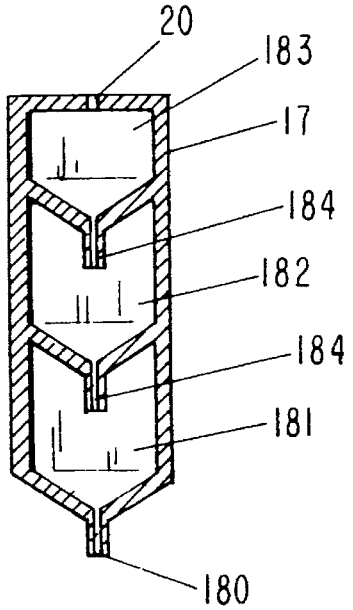
FIG. 7 in section an air inlet connection with stacked chambers as a part of the air inlet connection.

However, it is also possible to fill the container to more than half of its volume, for example, fill it completely with writing liquid 13, when the liquid volume to be received in the chamber 23 filled with the capillary medium 22, compare FIG. 1, or the volume of the chambers 181, 182, 183, compare FIGS. 5 and 7, together or the volume of the compensation container 174, compare FIG. 6, in relation to the volume of the container 14 is dimensioned sufficiently great.

When the air above the writing liquid 13 expands, these chambers 23, 181, 182, 183, 174, together serve as a compensation container with the volume $V_1$ for the displaced writing liquid 13.

For the determination of the volume $V_1$ of the compensation container the following equation is used:

$$0.5\ V_1 = \delta t \times \alpha \times 0.5\ V_0$$

whereby $V_0$ is the fillable volume of the container 14, $\delta$ t corresponds to the allowable temperature change at a constant air pressure and a temperature of for example 30° C., and $\alpha$ corresponds to the expansion coefficient of air of 1/273 per oC. The volume $V_1$ is thus $30/273 \times V_0$ and $$V_1 = \text{ca. } 0.1\ V_0.$$

All components of the device 10 can be manufactured from any suitable material, for example, plastic material, glass material, or metals in total or in part.

The present invention is, of course, in no way restricted to the specific disclosure of the specification and drawings, but also encompasses any modifications within the scope of the appended claims.

What is claimed is:

1. A device for filling a writing utensil having an applicator tip for applying a liquid, said device comprising:

a container for receiving a liquid, said container having an air inlet connection to connect an interior of said container to a surrounding atmosphere and further having an opening;

a receiving member for receiving the writing utensil or a liquid reservoir of the writing utensil, said receiving member sealingly connected within said opening;

a capillary liquid conveying connection, having a first and a second end, for conveying the liquid from said container into a writing utensil or a liquid reservoir of a writing utensil, said first end opening into said receiving member and contacting a writing tip of the writing utensil or an inlet of the liquid reservoir of the writing utensil; and said air inlet connection having a lower end with an inlet opening that opens into said interior and an upper end opening to the atmosphere, said air inlet connection comprising at least one chamber, positioned between said upper and lower ends and being wider than said upper and lower ends, for taking up a volume of writing liquid displaced from said interior through said inlet opening into said air inlet connection, wherein said air inlet connection extends directly upwardly from said inlet opening to said chamber.

2. A device according to claim 1, further comprising a closure element for closing off at least said first end of said capillary liquid conveying connection to the atmosphere.

3. A device according to claim 1, wherein a flow of liquid through said capillary liquid conveying connection is interrupted when said container is positioned substantially upside down.

4. A device according to claim 1, wherein said capillary liquid conveying connection extends into the vicinity of a bottom of said container.

5. A device according to claim 1, wherein said capillary liquid conveying connection has a circular cross-section and has a tubular wall for providing a capillary action.

6. A device according to claim 1, wherein said at least one chamber contains a capillary medium.

7. A device according to claim 1, wherein said capillary liquid conveying connection comprises a mantle.

8. A device according to claim 7, wherein said at least one chamber contains a capillary medium.

9. A device according to claim 1, wherein said receiving member is a one-part shaped member of a substantially cylindrical cross-section.

10. A device according to claim 9, wherein an inner wall of said receiving member has a plurality of projections extending substantially toward an axis of said receiving member.

11. A device according to claim 1, wherein a location of contact between said first end of said capillary device and the writing tip of the writing utensil or the inlet of the liquid reservoir of the writing utensil is above a level of liquid in said container in a rest position of said container.

12. A device according to claim 11, wherein said air inlet connection has an inlet opening in said interior of said container positioned in the area of an axis of said container.

13. A device according to claim 12, wherein in said rest position of said container said inlet opening is positioned above a level of liquid in said container.

14. A device for filling a writing utensil having an applicator tip for applying a liquid, said device comprising:

a container for receiving a liquid, said container having an air inlet connection to connect an interior of said container to a surrounding atmosphere and further having an opening;

a receiving member for receiving the writing utensil or a liquid reservoir of the writing utensil, said receiving member sealingly connected within said opening;

a capillary liquid conveying connection, having a first and a second end, for conveying the liquid from said container into a writing utensil or a liquid reservoir of a writing utensil, said first end opening into said receiving member and contacting a writing tip of the writing utensil or an inlet of the liquid reservoir of the writing utensil; and wherein said air inlet connection is comprised of an inlet opening in said interior of said container, a mouth open to the atmosphere, and a plurality of chambers connected between said inlet opening and said mouth.

15. A device according to claim 14, wherein said receiving member has a receiving opening for the writing utensil or the liquid reservoir of the writing utensil, and wherein said device further comprises a closure element for closing said receiving opening.

16. A device according to claim 15, wherein said closure element has a projection that is insertable into said receiving opening, said projection, in a closing position of said closure element, closing off said mouth of said air inlet connection and said first end of said capillary liquid conveying connection.

17. A device according to claim 14, wherein said chambers have separating walls separating said chambers from one another and wherein between said chambers connecting elements are positioned, said connecting elements being in the form of through-openings in said separating walls of said chambers.

18. A device according to claim 17, wherein said chambers have capillary grooves extending from a bottom of said chambers to said through-openings.

19. A device according to claim 18, wherein said chambers are arranged sequentially.

* * * * *